US006642935B1

(12) United States Patent
Soga

(10) Patent No.: US 6,642,935 B1
(45) Date of Patent: Nov. 4, 2003

(54) IMAGE DISPLAYING APPARATUS AND METHOD THEREOF

(75) Inventor: Kenji Soga, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/567,438

(22) Filed: May 10, 2000

(30) Foreign Application Priority Data

May 14, 1999 (JP) ..... 11-134087

(51) Int. Cl.[7] ..... G09G 5/02; G09G 5/22; G09G 5/30; G09G 5/32

(52) U.S. Cl. ..... 345/660; 345/636; 345/667; 345/694; 345/670; 345/671; 345/790; 345/797

(58) Field of Search ..... 345/667, 694, 345/670, 671, 636, 790, 797

(56) References Cited

U.S. PATENT DOCUMENTS 5,724,072 A * 3/1998 Freeman et al. ..... 345/636
5,729,704 A * 3/1998 Stone et al. ..... 345/804
6,429,878 B1 * 8/2002 Turek et al. ..... 345/636

FOREIGN PATENT DOCUMENTS

JP 61-138375 A 6/1986
JP 3-62084 A 3/1991
JP 4-281570 A 10/1992
JP 5-274441 10/1993
JP 6-175643 A 6/1994
JP 7-37116 A 2/1995
JP 7-306868 A 11/1995
JP 8-235190 A 9/1996
JP 9-46515 A 2/1997
JP 9-167235 A 6/1997
JP 10-333557 A 12/1998
JP 11-036792 2/1999

* cited by examiner

*Primary Examiner*—Michael Razavi
*Assistant Examiner*—Javid Amini
(74) *Attorney, Agent, or Firm*—Sughrue Mion, PLLC

(57) ABSTRACT

An image displaying apparatus and method thereof, being an image displaying technology of vector data, in which enlarging or reducing the vector data is performed after separating label information, being character information including in the vector data, and label display positions are determined. The image displaying apparatus consists of an image information storing means, an image display deciding means, an image display forming means, a bitmap data display selecting means, a display, a label extracting means, a label information storing means, and a label display selecting means. The image information storing means provides a vector data storing means which stores vector data of an original drawing, and a vector data projecting means which projects the vector data to four kinds of coordinate systems.

12 Claims, 6 Drawing Sheets

IMAGE DISPLAYING APPARATUS AND METHOD THEREOF

BACKGROUND OF THE INVENTION

The present invention relates to an image displaying apparatus and method thereof, which displays drawings, such as maps, network diagrams, circuit diagrams, and design diagrams on a display such as a cathode ray tube (CRT) in a computer system.

DESCRIPTION OF THE RELATED ART

Japanese Patent Application Laid-Open No. HEI 5-274441 discloses image displaying apparatus. In this application, nine sheets of bitmap are cut out from a kind of bitmap being a group of four sheets, and an image is formed by connecting the nine sheets of the bitmap. As another example of a conventional image displaying apparatus, Japanese Patent Application No. HEI 11-36792 discloses an image displaying apparatus and method thereof. In this application, a bitmap is formed by enlarging or reducing vector data.

FIG. 1 is a diagram showing a structure of this another conventional image displaying apparatus. As shown in FIG. 1, this conventional image displaying apparatus consists of an image information storing means 101, an image display deciding means 102, an image display forming means 103, a data display selecting means 104, and a display 105. And the image information storing means 101 includes a vector data storing means 111, and a vector data projecting means 112.

However, in the conventional technologies, in the method in which nine sheets of bitmap are cut out from a kind of bitmap being a group of plural sheets, and an image is formed by connecting the nine sheets of the bitmap, there is a problem that occurs frequently, i.e., a label positioned at the edge of the cut out bitmap is cut off from its middle part. And in the method in which the bitmap is formed by enlarging or reducing vector data, the label is also enlarged or reduced, consequently, it becomes difficult to read the characters.

SUMMARY OF THE INVENTION

It is therefore an object of the present invention to provide an image displaying apparatus and method thereof being an image displaying technology of vector data, in which enlarging or reducing the vector data is performed after separating label information (i.e., character information) included in the vector data, and determining a label display position.

According to a first aspect of the present invention for achieving the object mentioned above, at an image displaying apparatus which provides a vector data storing means for storing vector data used for enlarging or reducing a displayed image, an image display deciding means for determining an enlarging rate, display information, and a display region to be enlarged of said displayed image, and a display means for displaying said displayed processed image, the image displaying apparatus includes a label extracting means for extracting label information, being character information including in said vector data, from said vector data storing means, a label information storing means for storing label information that includes a group of a character string, display information, and a label display position, and a display label selecting means, to which said enlarging rate, said display information, and said display region to be enlarged of said displayed image are inputted from said image display deciding means, selects said label information in a group of said character string, said display information, and said label display position of said label information from said label information storing means, and determines a label display position, and outputs said label display position to said display means.

According to a second aspect of the present invention, in the first aspect, said display label selecting means searches for the display position of existing labels near the position of a candidate label display position where said label is desired to be displayed, and when no existing labels are displayed, determines said label display position as the candidate label position stored in said label information storing means, when one label exists near the position of said candidate label display position, said label display position is determined at a position a designated distance from said candidate label display position and on a straight line that extends through said candidate label display position to the display position of the existing label, when two labels exist near the position of said candidate label display position, said label display position is determined at a position a designated distance from said candidate label display position on a diagonal line of a parallelogram that extends through said candidate label display position, wherein said parallelogram has two sides that are two straight lines that extend from the display positions of said existing labels through said candidate label display position, when three or more labels exist near the position of said candidate label display position, said label display position is determined at a position at the center of a circle through which the three existing labels nearest said candidate label display position pass, when said candidate label display position extends out of a bitmap, said label display position is determined at a position a designated distance to the center of said bitmap so that said label is not cut at its middle part, and when said label display position is moved such that said label display position overlaps with one of said existing labels, display of said label is canceled.

According to a third aspect of the present invention, an image displaying method of an image displaying apparatus which provides a vector data storing means for storing vector data used for enlarging or reducing a display image, an image display deciding means for deciding an enlarging rate, display information, and a display region to be enlarged of said display image, and a display means for displaying said processed displayed image, included the steps of: extracting label information being character information includes in said vector data from said vector data storing means, storing label information to a label information storing means that includes a group of a character string, display information, and a label display position of said label, inputting said enlarging rate, said display information, and said display region to be enlarged of said displayed image to a label display selecting means from said image display deciding means, inputting selectively said label information to be displayed in characters to said label display selecting means from said label information storing means, deciding a label display position of said display image, and displaying an image on said display means after a plurality of bitmap data formed from said vector data are connected, by attaching said label on said bitmap data.

According to a fourth aspect of the present invention, in the third aspect, said label display selecting means, includes the steps of: searching for the display position of existing labels near the position of a candidate label display position where said label is desired to be displayed, determining said label display position at said candidate label display position stored in said label information storing means, when there are no existing labels, and determines said label display position at a position a designated distance from said candidate label display position and on a straight line extended through said candidate label display position from the display position of an existing label, when there is one existing label near the position of said candidate label display position.

According to a fifth aspect of the present invention, in the third aspect, said label display selecting means includes the steps of: searching for the display position of existing labels near the position of a candidate label display position where said label is desired to be displayed, and determining said label display position at a position a designated distance from said candidate label display position on a diagonal line of a parallelogram that extends through said candidate label display position, wherein said parallelogram has two sides that are two straight lines that extend from the display positions of said existing labels through said candidate label display position, when there are two labels near the position of said candidate label display position.

According to a sixth aspect of the present invention, in the third aspect, said label display selecting means includes the steps of: searching for the display position of existing labels near the position of a candidate label display position where said label is desired to be displayed, and determining said label display position at a position at the center of a circle which through which the three existing labels nearest to said candidate label display position, when there are three or more existing labels near the position of said candidate label display position.

According to a seventh aspect of the present invention, in the third aspect, said label display selecting means includes provides the steps of: searching for the display position of existing labels near the position of a candidate label display position where said label is desired to be displayed, and determining said label display position at a position a designated distance to the center of a bitmap so that said label is not cut at its middle part when said candidate label display position extends out of a bitmap.

According to an eighth aspect of the present invention, in the third aspect, said label display selecting means does not display the image, when said label display position overlaps with one of said existing labels.

According to a ninth aspect of the present invention, there is provided a program storing medium of an image displaying method defined in aspects 3, 4, 5, 6, 7 and 8.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
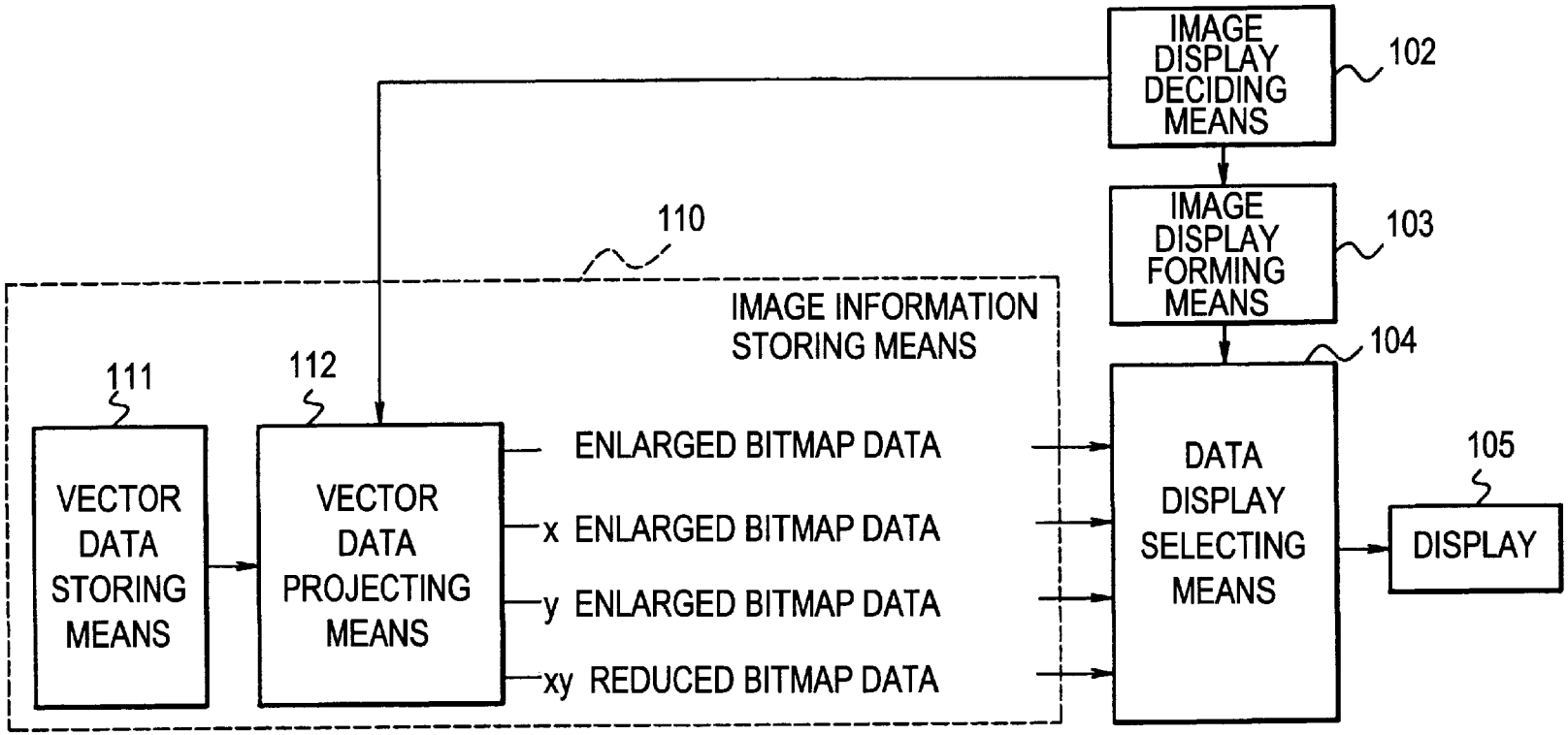
FIG. 1 PRIOR ART
FIG. 1 is a diagram showing a structure of a conventional image displaying apparatus.
Figure 2:
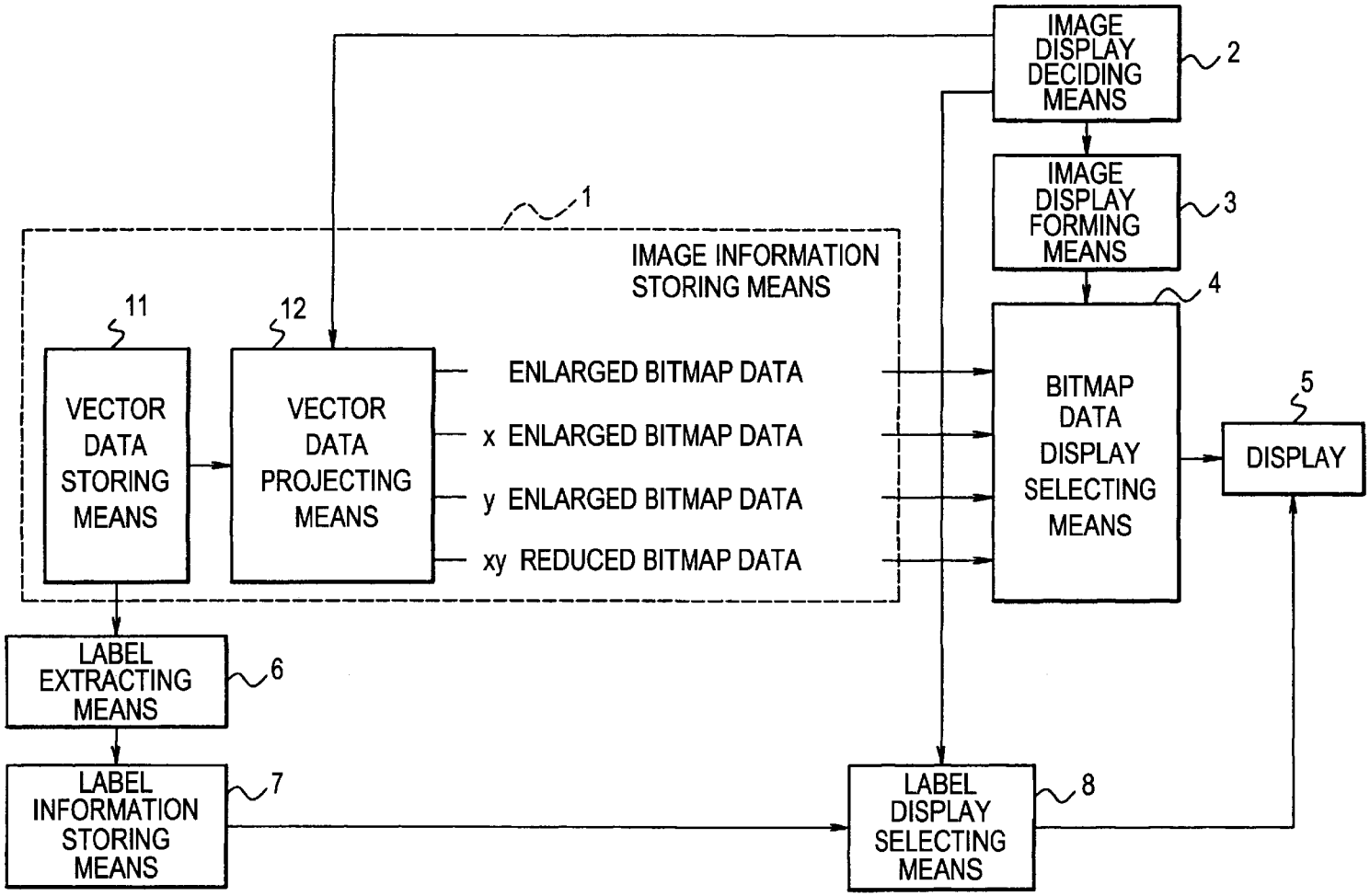
FIG. 2 is a diagram showing a structure of an embodiment of an image displaying apparatus of the present invention.

Referring now to the drawings, an embodiment of the present invention is explained in detail. FIG. 2 is a diagram showing a structure of the embodiment of an image displaying apparatus of the present invention. As shown in FIG. 2, the embodiment of the image displaying apparatus of the present invention consists of an image information storing means 1, an image display deciding means 2, an image display forming means 3, a bitmap data display selecting means 4, a display 5, a label extracting means 6, a label information storing means 7, and a label display selecting means 8.

The image information storing means 1 includes a vector data storing means 11, which stores vector data of an original drawing, and a vector data projecting means 12, which projects the vector data to four kinds of coordinate systems. The image display deciding means 2 determines an enlarging rate, display information, and a display region to be enlarged, of a displayed image. The image display forming means 3 calculates a rectangular display region that is cut out from the four bitmap data, based on the display region to be enlarged. The bitmap data display selecting means 4 cuts out the rectangular display region. The display 5 displays the bitmap data.

The label extracting means 6 extracts only label information from the vector data storing means 11, and the label information storing means 7 stores the extracted label information in a group of a character string, label display information, and a label display position. The display label selecting means 8 receives the enlarging rate, the display information, and the display region to be enlarged, of the display image, from the image display deciding means 2. The label display selecting means 8 selects the required label from the label information storing means 7 and determines its display position and outputs the required label and its determined position to the display 5.

Next, referring to FIG. 2, an operation of the embodiment of the image displaying apparatus of the present invention is explained. The image display deciding means 2 determines the enlarging rate (p, 1/q), the display information, and the display region to be enlarged of a bitmap to be displayed as an image. The vector data projecting means 12 obtains the enlarging rate (p, 1/q) and the display information from the image display deciding means 2. The vector data projecting means 12 forms an enlarged bitmap data, an "x" enlarged bitmap data, a "y" enlarged bitmap data, and an "xy" reduced bitmap data from the vector data stored in the vector data storing means 11, by using the enlarging rate (p 1/q) and the display information obtained from the image display deciding means 2 and outputs the formed data to the bitmap data display selecting means 4. In this embodiment, the enlarged bitmap data is formed by the vector data that is projected to a coordinate system multiplied by "p" to the "x" and "y" directions, the "x" enlarged bitmap data is formed by the vector data that is projected to a coordinate system multiplied by "p" to the "x" direction and multiplied by "1/q" to the "y" direction, the "y" enlarged bitmap data is formed by the vector data that is projected to a coordinate system multiplied by "1/q" to the "x" direction and multiplied by "p" to the "y" direction, and the "xy" reduced bitmap data is formed by the vector data that is projected to a coordinate system multiplied by "1/q" to the "x" and "y"

directions. The image display forming means 3 calculates a rectangular display region that is cut out from the four bitmap data, based on the display region to be enlarged, that is received from the image display deciding means 2. And the bitmap data display selecting means 4 cuts out the calculated rectangular display region from the four bitmap data, and the cutout region is displayed on the display 5.

When the enlarging rate (p, 1/q) determined at the image displaying deciding means 2 is changed, the enlarging rate of the bitmap data to be projected is changed, and finally the enlarging rate of the bitmap data to be displayed on the display 5 is changed.

Like the enlarging rate, when the display information, determined by the image display deciding means 2, is changed, the display information of the bitmap data to be projected is changed, and finally the display information of the bitmap data to be displayed on the display 5 is changed.

As mentioned above, by only storing one vector data, a bitmap data having an arbitrary enlarging rate or arbitrary displaying information can be displayed.

Next, an operation of a displaying a label based on label information is explained. When a vector data to be displayed is stored in the vector data storing means 11, the label extracting means 6 extracts label information. The label information is stored in the label information storing means 7 in a group of a character string, display information, and a display position.

When an image is displayed on the display 5, the label display selecting means 8 obtains the enlarging rate (p, 1/q) and the display information from the image display deciding means 2. And the label display selecting means 8 selects the label information to be displayed from the label information storing means 7 based on the display information.

Next, movement of the display position of the selected label and the method for determining the position are explained. First, in the situation where an existing label is displayed near the position where the selected label is desired to be positioned, the display positions of the existing displayed labels, which are positioned near a candidate label display position of the selected label, are determined.

In the situation where no labels exist near the candidate position, a display position stored in the label information storing means 7 is determined as the position of the selected label.

Figure 3:
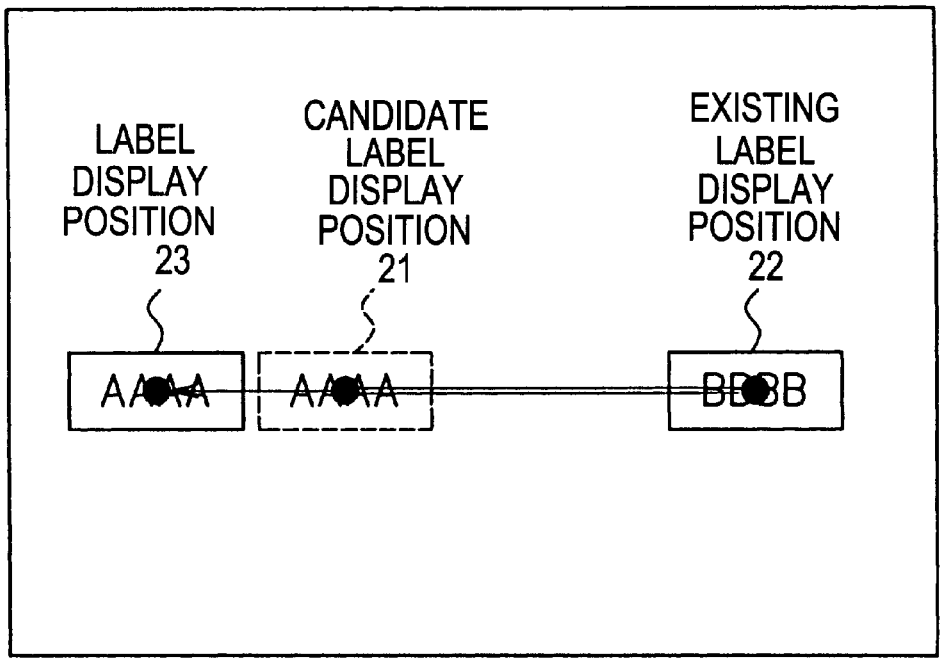
FIG. 3 is a diagram showing a first example of moving a display position of a selected label.

FIG. 3 is a diagram showing a first example of moving the display position of the selected label (AAAA). As shown in FIG. 3, in the situation where one label 22 (BBBB) already exists near the position of a candidate label display position 21, a label display position 23 is determined at a position that is a designated distance from the candidate label display position 21 and on a straight line that extends through the candidate label display position 21 to the existing label display position 22.

Figure 4:
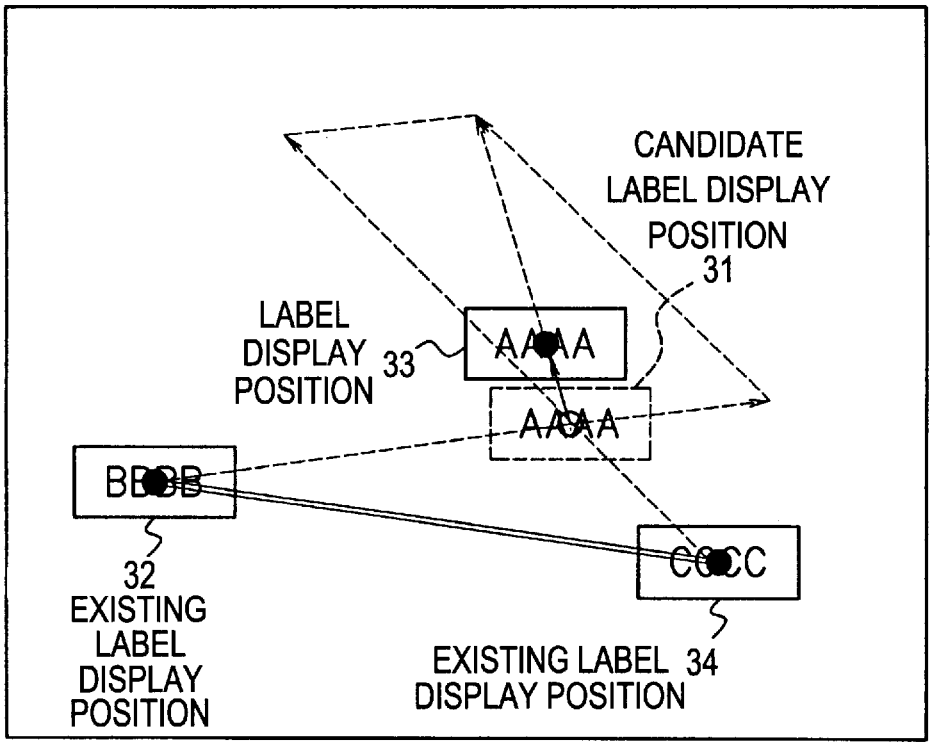
FIG. 4 is a diagram showing a second example of moving a display position of a selected label.

FIG. 4 is a diagram showing a second example of moving the display position of the selected label. As shown in FIG. 4, in the situation where two labels 32 (BBBB) and 34 (CCCC) already exist near the position of a candidate label display position 31, a label display position 33 is determined at a position that is a designated distance from the candidate label display position 31 on a diagonal line of a parallelogram that extends through the candidate label display position 31, wherein the parallelogram has two sides that are two straight lines that extend from the display positions of the display position of existing labels 32 and 34 through the candidate label display position 31.

Figure 5:
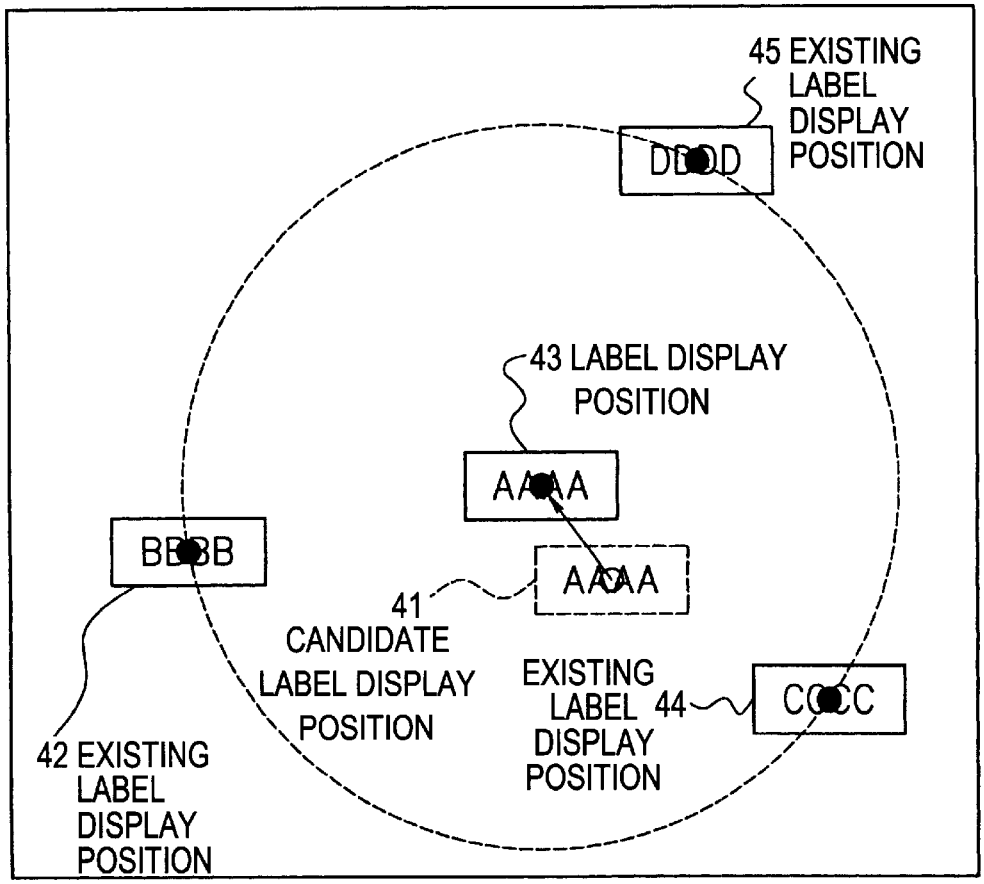
FIG. 5 is a diagram showing a third example of moving a display position of a selected label.

FIG. 5 is a diagram showing a third example of moving the display position of the selected label. In the situation where three or more labels 42 (BBBB), 44 (CCCC) and 45 (DDDD) already exist near the position of the candidate label display position 41, as shown in FIG. 5, the label display position 43 is determined at a position at the center of a circle through which existing labels 42, 44 and 45 being the three nearest to the candidate label display position 41, pass.

In the first, second and third examples, if when the display position of the selected label is moved, the selected label comes in contact with an existing label, display of the selected label is cancelled.

Figure 6:
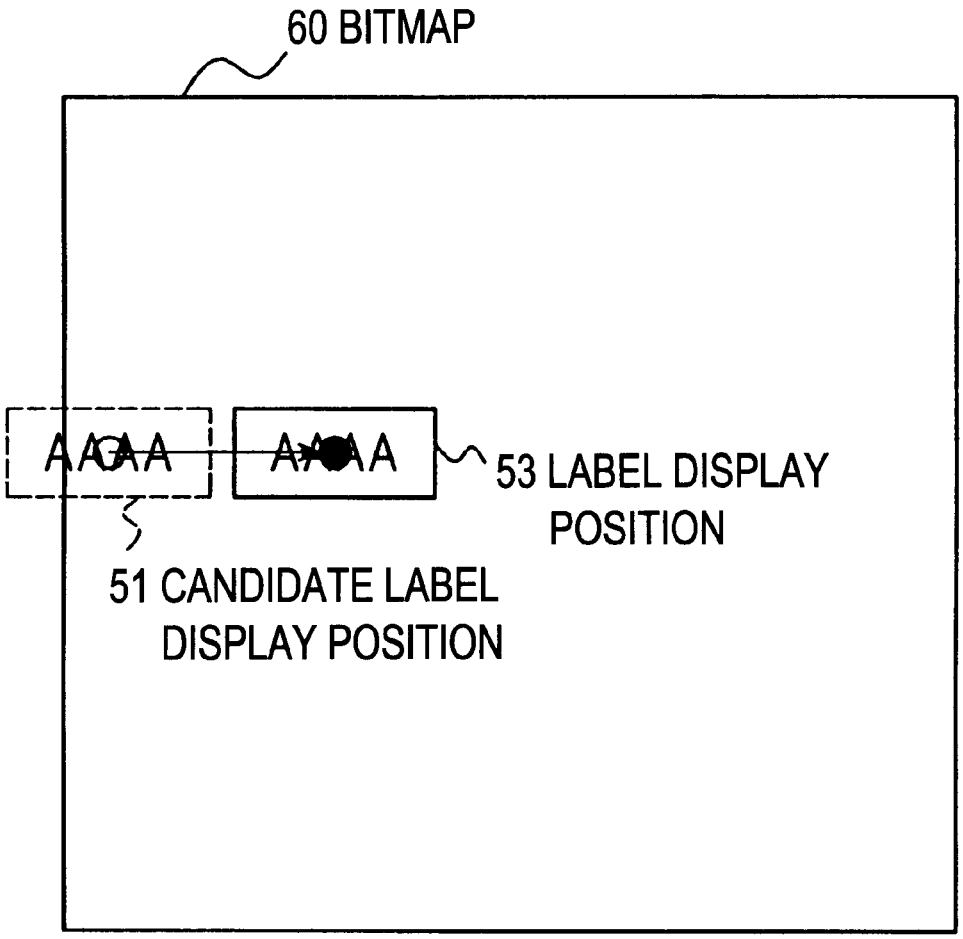
FIG. 6 is a diagram showing the situation in which a candidate label position extends out of a bitmap.

FIG. 6 is a diagram showing the situation in which a candidate label display position extends out of a bitmap. As shown in FIG. 6, a candidate label display position 51 extends out of a bitmap 60. In this situation, a label display position 53 is moved a designated distance to the center of the bitmap and the selected label is displayed such that it is not cut at its middle part.

As mentioned above, the label display selecting means 8 determines the display position of the label and outputs the display position to the display 5. The display 5 connects the enlarged bitmap data, the "x" enlarged bitmap data, the "y" enlarged bitmap data, and the "xy" reduced bitmap data, and then, the label is attached. As a result, at the connecting part where the enlarging or reducing scale is changed, the label cannot be cut at its middle part.

In one embodiment of the present invention, the number of characters in the character string is set to four and the number of the character strings is a maximum of three existing labels. However, the number of characters in a character string and the number of character strings is not limited to the numbers mentioned in the embodiment, and any number can be applied to meet the spirit of the present invention.

As mentioned above, in the present invention, the characters displayed in the label are not enlarged or reduced, therefore the characters can be displayed so that they are easy to read. Moreover, the number of the character strings can be adjusted to correspond to the size of the bitmap.

While the present invention has been described with reference to the particular illustrative embodiments, it is not to be restricted by those embodiments. It is to be appreciated that those skilled in the art can change or modify the embodiments without departing from the scope and spirit of the present invention.

What is claimed is:

1. An image displaying apparatus which provides a vector data storing means for storing vector data used for enlarging or reducing a display image, an image display deciding means for determining an enlarging rate, display information, and a display region to be enlarged of said display image, and a display means for displaying said processed image display, comprising:

a label extracting means for extracting label information, being character information included in said vector data, from said vector data storing means;

a label information storing means for storing label information comprising a character string, display information, and a label display position; and a label display selecting means, to which said enlarging rate, said display information, and said display region to be enlarged of said display image are inputted from said image display deciding means, selects said label information in a group of said character string, said display information, and said label display position of said label information from said label information storing means, and determines a display position of said label, and outputs said display position of said label to said display means; wherein said label display selecting means searches for display positions of labels existing near a candidate label display position, and when said candidate label display position extends out of a bitmap, determines said label display position at a position a designated distance to the center of said bitmap so that said label is not cut at its middle part.

2. An image displaying apparatus according to claim 1, wherein:

said label display selecting means searches for display positions of labels existing near a candidate label display position, and when no existing labels are displayed, determines said label display position as said candidate label display position stored in said label information storing means; and when one label exists near a position of said candidate label display position, determines said label display position at a position a designated distance from said candidate label display position and on a straight line extended through said candidate label display position to the display position of said existing label; and when two labels exist near a position of said candidate label display position, determines said label display position at a position a designated distance from said candidate label display position on a diagonal line of a parallelogram that extends through said candidate label display position, wherein said parallelogram has two sides that are two straight lines that extend from the display position of said existing labels through said candidate label display position;

when three or more labels exist near the position of said candidate label display position, determines said label display position at a position at the center of a circle through which the three existing labels nearest said candidate label display position pass; and when said label display position is moved such that said label display position overlaps with one of said existing labels, cancels display said label.

3. An image displaying method of an image displaying apparatus which comprises a vector data storing means for storing vector data used for enlarging or reducing a display image, an image display deciding means for determining an enlarging rate, displaying information, and a displaying region to be enlarged of said display image, and a display means for displaying said processed display image, comprising:

extracting label information, being character information including in said vector data, from said vector data storing means;

storing label information comprising a character string, display information, and a label display position in a label information storing means;

inputting said enlarging rate, said display information, and said display region to be enlarged to a label display selecting means from said image display deciding means;

inputting selectively said label information to be displayed to said label display selecting means from said label information storing means;

determining a label display position of said display image; and displaying an image on said display means after a plurality of bitmap data formed from said vector data are connected, by attaching said label on said bitmap data; wherein:

said label display label selecting means, comprises:

searching for the display positions of existing labels near the position of a candidate label display position; and when said candidate display extends out of a bitmap, determining said label display position at a position a designated distance to the center direction of said bitmap so that said label is not cut at its middle part.

4. An image displaying method according to claim 3, wherein:

said label display label selecting means, comprises:

searching for the display positions of existing labels near the position of a candidate label display position; and when no labels exist near the position of said candidate label display position, determining said label display position to be said candidate label display position stored in said label information storing means; and when one label exits near the position of said candidate label display position, determining said label display position at a position a designated distance from said candidate label display position and on a straight line extended through said candidate label display position to the display position of said existing label.

5. An image displaying method according to claim 3, wherein:

said label display selecting means, comprises:

searching for the display positions of existing labels near the position of a candidate label display position; and when two labels exist near the position of said candidate label display position, determining said label display position at a position a designated distance from said candidate label display position on a diagonal line of a parallelogram that extends through said candidate label display position, wherein said parallelogram has two sides that are two straight lines that extend from the display position of said existing labels through said candidate label display position.

6. An image displaying method according to claim 3, wherein:

said label display label selecting means, comprises:

searching for the display positions of existing labels near the position of a candidate label display position; and when three or more labels exist near the position of said candidate label display position, determining said label display position at a position at a center of a circle through which the three existing labels nearest said candidate display position pass.

7. An image displaying method according to claim 3, wherein:

when said label display position is moved such that said label display position overlaps with one of said existing display positions, canceling display of said label.

8. A program storing medium of an image displaying method defined in claim 3.

9. A program storing medium of an image displaying method defined in claim 4.

10. A program storing medium of an image displaying method defined in claim 5.

11. A program storing medium of an image displaying method defined in claim 6.

12. A program storing medium of an image displaying method defined in claim 7.

* * * * *